United States Patent [19]

Vilcinskas

[11] 4,303,355

[45] Dec. 1, 1981

[54] ADJUSTABLE ANCHORED BULKHEAD SYSTEM

[76] Inventor: Charles K. Vilcinskas, 769 Dunrobin Ave., Ottawa, Ontario, Canada, K1G 3E5

[21] Appl. No.: 112,825

[22] Filed: Jan. 17, 1980

Related U.S. Application Data

[63] Continuation of Ser. No. 4,193, Jan. 17, 1979, abandoned.

[30] Foreign Application Priority Data

Feb. 8, 1978 [CA] Canada ..... 296469

[51] Int. Cl.[3] ..... E02D 5/74

[52] U.S. Cl. ..... 405/262; 405/284

[58] Field of Search ..... 405/258–262, 405/284–287, 272–281; 52/98, 167; 116/200, DIG. 34; 73/761, 762, 784

[56] References Cited

U.S. PATENT DOCUMENTS

| | | | |
|---|---|---|---|
| 1,057,686 | 4/1913 | Thomas et al. | 116/DIG. 34 |
| 1,774,695 | 9/1930 | Baynes | 116/DIG. 34 |
| 4,154,554 | 5/1979 | Hilfiker | 405/273 |

FOREIGN PATENT DOCUMENTS

| | | | |
|---|---|---|---|
| 2304770 | 10/1976 | France | 405/259 |

*Primary Examiner*—Dennis L. Taylor

*Attorney, Agent, or Firm*—Cushman, Darby & Cushman

[57] ABSTRACT

The invention relates to a system for providing limited stresses for anchored bulkhead's elements. An automatic stress controlling device is positioned between front and rear steel bearing plates and comprises a brittle component such as concrete, adjacent a flexible core of lead. If the system experiences excessively high stress, the concrete breaks giving a visual indication of the condition, while the lead permits the device to yield. A strain gauge can also be electrically connected to a remote panel for monitoring.

6 Claims, 13 Drawing Figures

ADJUSTABLE ANCHORED BULKHEAD SYSTEM

This application is a continuation application of my copending U.S. application, Ser. No. 4,193, filed Jan. 17, 1979 now abandoned.

The invention relates to a system for providing limited stresses for anchored bulkhead's elements.

Anchored bulkheads have been in use on a worldwide scale for hundreds of years, probably since pre-Roman years. In spite of this and many various existing theories, structural problems remain highly indeterminate. Earth pressure is a primary function of the soil-structure factors which affect anchored bulkheads.

It is an object of the invention to assure a competent yield of retaining structures while maximum shear resistance in the soil is mobilized to minimize lateral pressure and increase passive resistance, thereby relieving the stresses of all structural components.

It is a further object of the invention to increase the fixity of bulkheads in the soil and basically, to provide an economical solution of the existing problem.

This invention for anchored bulkheads may be put into operation by using either one of two special devices. One is an automatic stress controlling device, with minimum creep, and for the assurance of adequate yield to protect all the material of construction from overstressing. I found that these two requirements may be met by combining two basic components.

One of these components, the load bearing component, must be produced of a strong and very brittle substance with minimum creep such as special made concrete, or other suitable material. This component can be safely dimensioned on the basis of $f_l = C_e f_{cu}$; $f_l$—limit states stresses of the material used, $C_e$—efficiency factor, which depends on the ratio of long-time to short-time ultimate strength in compression and the precision of production. (If specially made concrete is used the initial efficiency factor could be 0.85). $f_{cu}$—ultimate strength of material. (All influences like shape, size, age and others must be taken into account).

Generally the thickness of the load bearing component should be the same as the distance through which the bulkhead must yield to assure minimum active earth pressure.

The second component of device must be produced of a plastic material, such as lead or its alloys. The thickness of the plastic component is preferably slightly smaller than the load bearing component of the device.

When the first, the load bearing component fails, the second component must have adequate capacity to take over all the load while providing a smooth yield of the structure with assurance of the overall stability of adjustable system and the integrity of its various structural elements.

Components should be located between steel bearing plates. The plates must be well designed to resist acting forces. If the thickness of plates reach dimensions, which are too large to be economical, the front plate could be reinforced by using ribs or special nuts and the thickness of rear plates, if necessary, could be limited by providing reinforced base on wales. It is recommended for big tie rod forces to have bearing plates of high strength steel.

When materials of bulkhead's elements reach the stress limit, the devices yield, thereby relieving soil pressure and stress. Then the devices must be replaced at once with the new devices in order to maintain control of stress in the future. Destruction of devices could be confirmed doing visual inspection or with some sort of signalling. This device is an integral and important part of this system and must be, therefore, carefully produced. The surface of concrete, which is contacted by lead, should be accordingly protected. The automatic stresses controlling devices could be produced of other material with similar properties.

In accordance with a second aspect of the invention, an excellent performance is obtained by using devices with the combined controlling stresses mechanism. It consists of a permanent electronic component, which indicates limited stresses and an applied mechanical component for assurance adequate yield of retaining structure to get minimum active and increased passive soil pressures. In this case the stresses of all structural elements could be very precisely evaluated. It provides the realistic possibility to use the anchored bulkhead's system for various soils and conditions to get the most economical solution.

This aspect of the invention involves the use of a strain gauge for limited stresses, which should be installed at the tie rod and at the main points of bulkhead. All results of the bulkhead stresses should be presented in the central controlling station, from where all necessary coordinations can be implemented.

Generally, the location of controlling stresses devices for the rods are located at the bulkheads, but where the local conditions offer more economical solution, they could be installed at the anchor walls, by using the concept of this invention.

During replacement of automatic controlling stress devices or during operation with combined controlling stresses mechanism, the action must be provided gradually and very smooth, as not to overstress all the structural elements of anchored bulkheads.

In drawings, which illustrate embodiments of the invention, for one of the tie rods to make the conventional steel sheetpiling wall adjustable, FIG. 1 is a plan, partly in section embodiment, where the tie rod ends beyond adjustable sheetpiling wall with the automatic stresses controlling device;

The drawings show a bulkhead system for retaining soil which is particularly suitable for harbour walls. The system includes conventional pile sheeting, held in place by tie rods. The tie rods are generally conventional but are provided with special devices connecting the outer ends of the tie rods to the bulkhead and include both a brittle component which, when broken, indicates excess stress in the tie rod, and a yieldable, plastic component which allows movement of the bulkhead relative to the tie rod under action of this stress. The device is arranged so that the brittle component can be readily inspected.

During the production of the automatic stress devices; representative samples should be tested to ensure that the load bearing and plastic components are acting in accordance with the design conditions.

Figure 8:
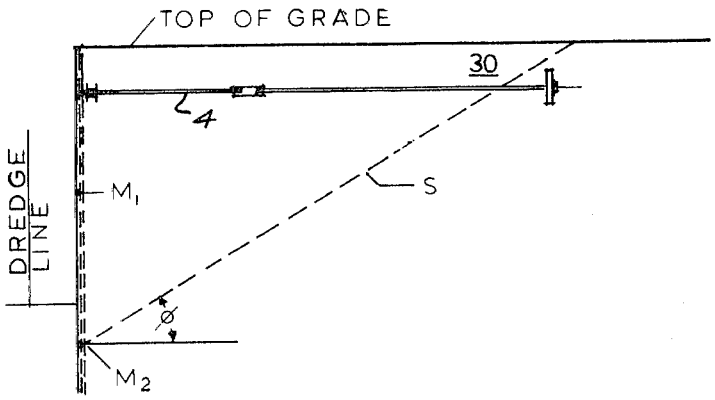
FIG. 8 is a sectional elevation showing the location of a single anchor wall and the bulkhead system with the soil.

FIG. 8 is a sectional elevation showing the location of a single anchor wall and the bulkhead system with the soil 30 which is retained above line S, the slope of friction, angle $\phi$. At point $M_2$, the movement in the wall is estimated at zero.

Figures 1, 2:
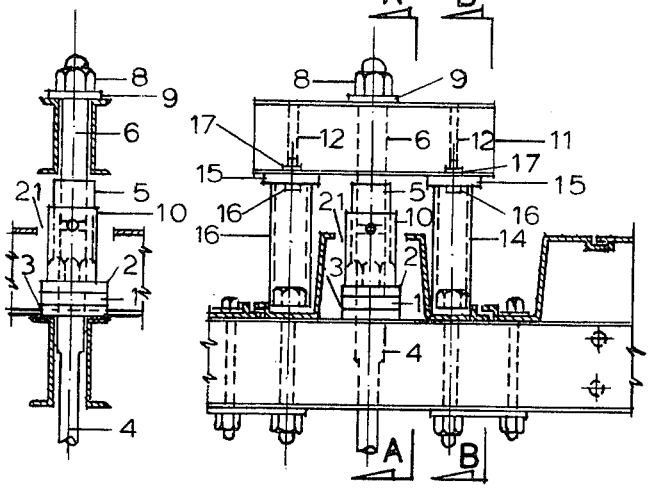
FIG. 2 is a section "A—A" of FIG. 1.
Figure 3:
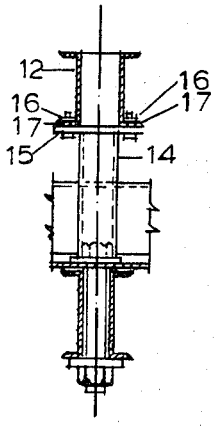
FIG. 3 is a section "B—B" of FIG. 1.
Figure 4:
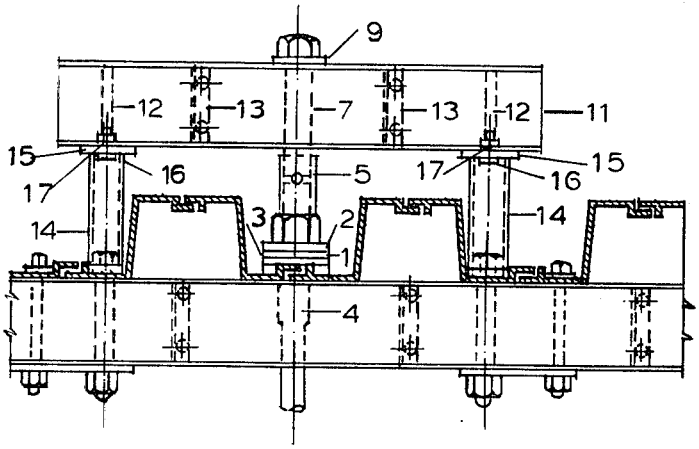
FIG. 4 is a plan partly in section of one embodiment, where the tie rod is exposed in front of adjustable sheetpiling wall with automatic stresses controlling device.

With reference to the drawings, controlling mechanism 1 has a front steel bearing plate 2 and a rear steel bearing plate 3. Tie rod 4 is connected with the anchorage by means of coupling 5. A screw bar 6 (as shown in FIG. 1) or a bolt 7 (as shown in FIG. 4) may be used as the anchorage. Screw bar 6 is secured by nut 8. Numeral 10 indicates a socket.

The steel bearing plate 9 transfers the load of the tie rod 4 to the beam 11. Load carrying beam 11 has vertical plates 12 welded to the channels which are secured by spacers 13. The beam is supported by metal tube posts 14, having a welded metal bearing plate 15 on top which are connected to beam 11 by means of bolts 16. Slotted holes 17 may be provided in the beam for applicable installations.

Figure 9:
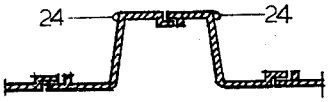
FIG. 9 is a partly sectional plan of FIG. 8 at the point $M_1$.

FIG. 9 is a partly sectional plan of FIG. 8 at the point $M_1$, where the maximum bending movement is estimated to be. A conventional strain gauge 24 may be attached to the bulkhead to signal if excess strain were to occur.

Figure 10:
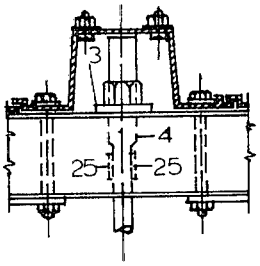
FIG. 10 is a partly sectional plan of FIG. 8 at the tie rod.

FIG. 10 is a partly sectional plan of FIG. 8 at the tie rod. One or more strain gauges 25 may be located on the tie rod 4. The strain gauge 24 or 25 may be wired to a central panel which would give a signal if excess strain were to occur. The strain would be relieved simply by loosening the nuts of the tie rods. Every nut rests, in accordance with the conventional practice, on a single bearing plate.

Load bearing component 18 is preferably a pad of concrete and plastic component 19 is preferably lead. Flexible elements 20 acts as a hinge and holds left and right parts of the device for installation. Opening 21 allows for the replacement of the automatic controlling mechanism and for the application of a torsion moment to tune the anchorage. These openings should be closed by bolted steel plates when all of the operations have been completed.

Figures 11, 12, 13:
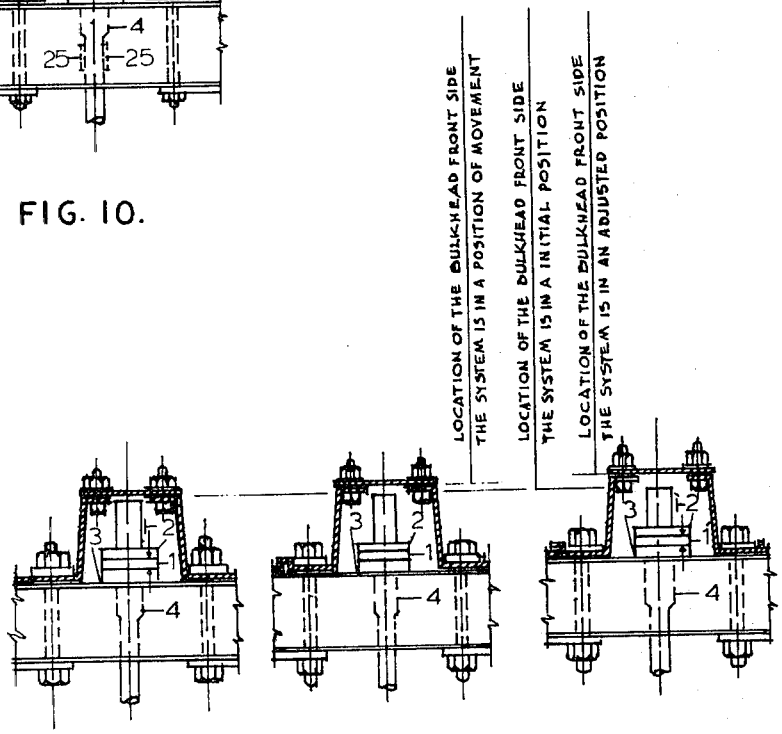
FIG. 11 is a plan, partly in section, showing the bulkhead system in an initial position.
FIG. 12 shows the system of FIG. 11 in a position of movement.
FIG. 13 shows the system of FIGS. 11 and 12 in a final position of the moved bulkhead.

FIG. 11 is a plan, partly in section, showing the bulkhead system in an initial position. The symbol T represents the thickness of the automatic stress controlling device 1. FIG. 12 shows the system in a position of movement and FIG. 13 shows the system in a final position of movement, after insertion of a new automatic stress controlling device $1^1$. The new thickness of the automatic stress controlling device $1^1$ is $T^1$, which has been estimated to be necessary.

Figure 5:
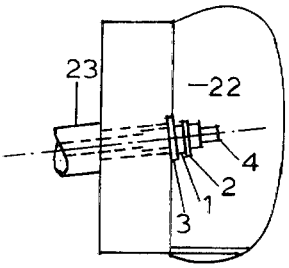
FIG. 5 is a sectional elevation of one embodiment, when stresses controlling devices are installed at anchor walls.
Figure 7:
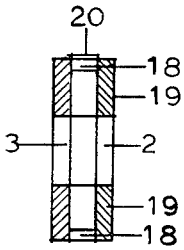
FIG. 7 is a section "C—C" of FIG. 6, showing bearing plates, as well, of automatic stresses controlling device 1, which is to be replaceable.
Figure 6:
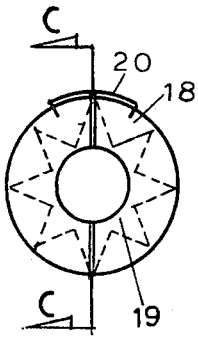
FIG. 6 is a plan of automatic controlling stresses device (general size and shape depends on the tie rod force and the material of its components)

FIG. 5 show a control tunnel 22, which may take the form of a man-hole, which allows access to the stress controlling device 1, so that it can be replaced, if necessary. In this embodiment, the tie rod 4 is encased in conduit 23.

FIGS. 1, 4 and 5 show that there are no problems in implementing the combined stresses controlling mechanism and to make steel sheetpiling wall adjustable.

The invention has been described by the disclosure and in the accompanying drawings. It is intended that minor modifications may be made in the construction and in the arrangement of components. These modifications, however, will be inseparable within the scope of the appended claims of this invention.

The accessories of the bulkhead anchorage should have higher safety factor than others. The stability of working platform should be provided in accordance with the local conditions.

I claim:

1. An adjustably anchored bulkhead system for retaining soil, having tie rods for holding the bulkhead in place, wherein means are provided for indicating when said tie rods are subjected to excess stresses, said system having provision for relieving the excess stress to allow the movement of the bulkhead while maintaining tension in the tie rods, wherein said means for indicating excess stresses include a replaceable device located between the bulkhead and the end of a tie rod, said device including a brittle component designed to fracture when the tie rod is subjected to excess stress, and a yieldable component which is subjected to stress when said brittle component has fractured and which yields to allow movement of the bulkhead.

2. A system according to claim 1, wherein said brittle component is concrete.

3. A system according to claim 1, wherein said yieldable component is lead.

4. A system according to claim 1, wherein said means for indicating stresses include a strain gauge, and wherein said tie rods are adjustable to allow movement of the bulkhead.

5. A system according to claim 4, wherein said strain gauge is located at a point on said bulkhead subjected to bending movements.

6. A system according to claim 4, wherein said strain gauge is located on a tie rod.

* * * * *